United States Patent [19]

Trenary et al.

[11] Patent Number: 4,588,130

[45] Date of Patent: May 13, 1986

[54] SHOWERHEAD

[75] Inventors: John M. Trenary; Joseph G. Mammoser, both of Fort Collins, Colo.

[73] Assignee: Teledyne Industries, Inc., Fort Collins, Colo.

[21] Appl. No.: 571,577

[22] Filed: Jan. 17, 1984

[51] Int. Cl.[4] ..... B05B 3/06

[52] U.S. Cl. ..... 239/381; 239/447; 239/449

[58] Field of Search ..... 239/380–383, 239/102, 447, 448, 449

[56] References Cited

U.S. PATENT DOCUMENTS

| | | | |
|---|---|---|---|
| 3,762,648 | 10/1973 | Deines et al. | 239/383 |
| 3,801,019 | 4/1974 | Trenary et al. | 239/383 |
| 3,958,756 | 5/1976 | Trenary et al. | 239/383 |
| 4,190,207 | 2/1980 | Fienhold et al. | 239/381 |
| 4,303,201 | 12/1981 | Elkins et al. | 239/383 |
| 4,398,669 | 8/1983 | Fienhold | 239/447 |

*Primary Examiner*—Andres Kashnikow
*Assistant Examiner*—Michael J. Forman
*Attorney, Agent, or Firm*—Hugh H. Drake

[57] ABSTRACT

A showerhead has a series of orifices together with a series of spray outlets and a turbine with a valve for sequentially opening successive ones of the orifices. The turbine is driven by water emitted from a nozzle. A multiply-apertured flow director plate communicates water to the nozzle, the orifices and the outlets. Overlying the director plate is a control plate that selectively couples water to different ones of the apertures in the director plate as the latter is moved by a control ring. First, second and third passages are defined in the showerhead, the first between an aperture in the director plate to the nozzle and also through the valve to the orifices, the second from an aperture in the director plate to the outlets and the third from an aperture in the director plate in bypass of the nozzle but through the valve to the orifices in a manner to retard the speed of the turbine. A first set of shutters on the control plate serves to close the third passage, open the first passage and variably open the second passage during opening of the first passage as the control plate is moved. A second set of shutters also defined on the control plate close the first and second passages, while opening the third passage again as the control is moved. The different combinations include a mode in which a comparatively slow delivery of pulses is combined with the delivery of a spray.

8 Claims, 28 Drawing Figures

SHOWERHEAD

The present invention relates to showerheads. More particularly, it pertains to multiple-mode showerheads, having different combinations of continuous spray and pulsating delivery.

U.S. Pat. No. 3,762,648, issued Oct. 2, 1973, discloses a showerhead which delivers a pulsating stream that may be varied from slow to fast, as distinguished from even earlier showerheads that delivered only continuous sprays which might be adjustable to vary the pattern of delivery. U.S. Pat. No. 3,801,019, issued Apr. 2, 1974, directs attention to a showerhead which allows selectibility as between pulsating and continuous delivery. Its degree of adjustment is from a selection as between fast to slow pulsating delivery and a combination of pulsation together with continuous flow and a reduction in frequency of pulsation as the unit is adjusted toward a mode of all-continuous flow. U.S. Pat. Nos. 3,958,756 and 4,190,207 describe showerheads that have characteristic selection as between modes which basically are in the same sequence as in the aforesaid U.S. Pat. No. 3,801,019.

U.S. Pat. No. 4,303,201 teaches the inclusion of a soft central spray pattern in addition to a more incisive outer spray pattern, both combined with the availability of pulsating flow. It further provides for adjustment to attain differences from hard to soft in perception of the pulses, as felt on the skin of the user. At the same time, adjustments as between different combinations of the modes permit variation in frequency of the pulsation. One mode available to the user involves an outer spray pattern together with the delivery of fairly-hard pulses, while another mode allows the delivery of slower pulses with a soft delivery and a still different mode allows the delivery of fast pulses in a soft characteristic.

U.S. Pat. No. 4,398,669 has a still different combination of features. They include the delivery of either an outer spray or central spray, or a combination of the two, together with the delivery of pulses which may be fast or slow. A separate shutter element is required to achieve pulse perception at the skin of the user.

All of the references enumerated above are assigned to the same assignee as is the present application. Many of the various features described therein have found their way into products which have proved to be highly successful in the marketplace. In the devices of those of the references that allow adjustability as between continuous spray and pulsating spray, one limitation encountered has been that the degree of adjustment has been limited by stops which define the beginning and end of a sequence of selection as between different modes of operation. Those stops had also been desirable to prevent the possibility of stalling of the pulsation unit in a slow mode thereof. The existence of those stops may undesirably cause a user to have to retrace the steps of adjustment back through undesired modes in order to reach what was a beginning mode. In addition, the stops may be fractured as a result of excessive force imposed by the user. In that case, the relationship with indicia of mode selection becomes highly confusing to the user.

It is therefore, one general object of the present invention to overcome such deficiencies by achieving a wide selection of different modes of delivery of the water, while yet allowing that to be accomplished by continual adjustment of a control throughout a repetitive succession of mode changes.

It is believed to be desirable to provide a mode of operation in which the showerhead delivers a comparatively slow succession of water pulses, while at the same time bathing the user with a continuous spray pattern. This mode of operation is not possible with the showerheads of any of the aforenoted references.

It is, accordingly, another general object of the present invention to supply the additional feature of allowing the user to enjoy both a continuous spray and a rather slow massage action.

A further object of the present invention is to provide an assemblage which accomplishes one or both of the previously-stated objectives without requiring the expense of significant retooling of the various parts that were used in the manufacture of an earlier showerhead, such as that shown in the aforesaid U.S. Pat. No. 3,958,756.

A showerhead constructed in accordance with the present invention includes an inlet, a series of circumferentially-spaced orifices, a series of spray outlets, a turbine with a valve for sequentially opening successive ones of the orifices and at least one nozzle for driving the turbine. A multiply-apertured flow director communicates water to the nozzle, the orifices and the outlets. A control selectively couples water from the inlet to different ones of the apertures in the director. Included are means for moving the control relative to the director. Defined within the showerhead is a first passage from at least a first aperture in the director to the nozzle and through the valve to the orifices. A second passage is defined from at least a second aperture in the director to the outlets. Then, there is defined a third passage from at least a third aperture in the director and in bypass of the nozzle but through the valve to the orifices and, directly or indirectly, in retardive interaction with the turbine. Defined on the control plate are first shutter means that close the second passage, open the first passage and variably open the third passage during opening of the first passage as the control is moved. Second shutter means also on the control close the first and third passages while opening the second passage as the control is moved. The first and second shutter means are mutually oriented to open the third passage when the control is moved to a position in which both of the first and second passages are at least partially opened. Desirably, the various openings and closures overlap.

The features of the present invention which are believed to be patentable are set forth with particularity in the appended claims. The organization and manner of operation of the invention, together with further objects and advantages thereof, may best be understood by reference to the following description taken in connection with the accompanying drawings, in the several figures of which like reference numerals identify like elements, and in which:

Figure 4:
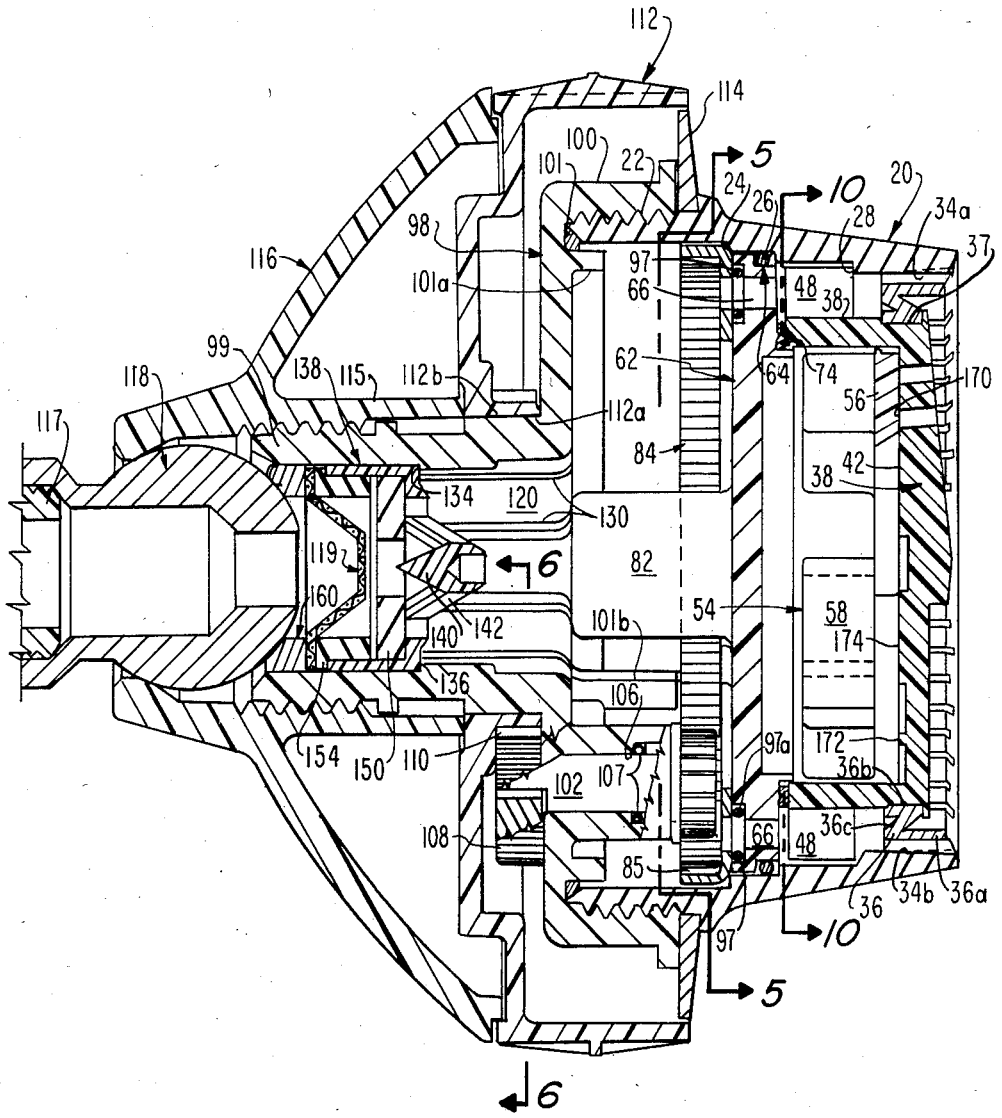
FIG. 4 is a cross-sectional view taken along the line 4—4 in FIG. 2.
Figure 6:
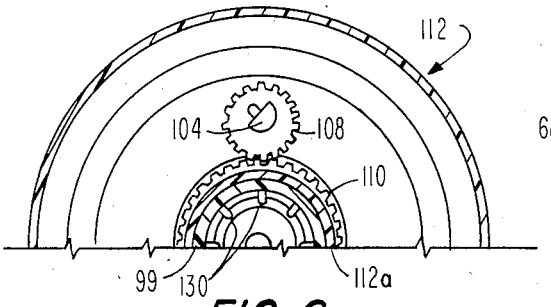
Figure 7:
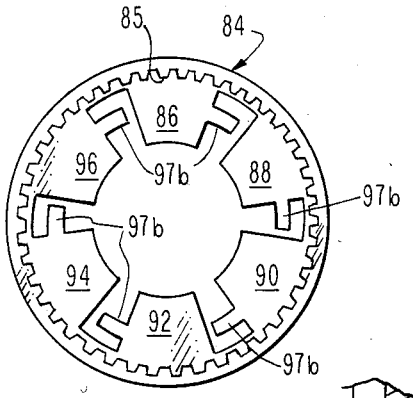

FIGS. 5*a*–5*d* are cross-sectional views taken along the line 5—5 in FIG. 4 and respectively depicting shutter valve operation at different positions within its range of movement;

FIG. 6 is a partial cross-sectional view taken along the line 6—6 in FIG. 4 and inverted, FIG. 7 is a plan view of a shutter plate depicted particularly in FIGS. 3 and 4 and the application of which is explained in connection with FIGS. 5*a*–5*d;*

Figure 2:
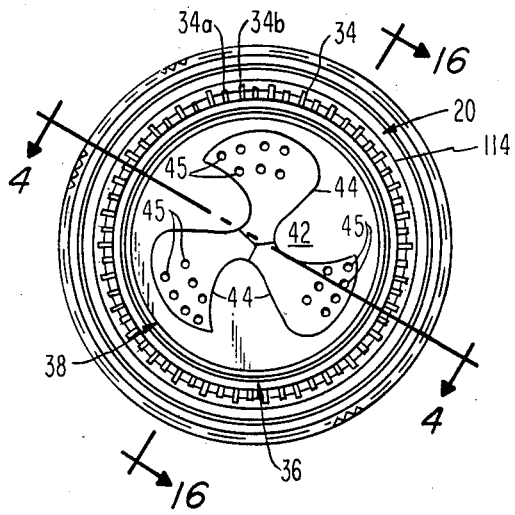
FIG. 2 is a front view of the showerhead.
Figure 3:
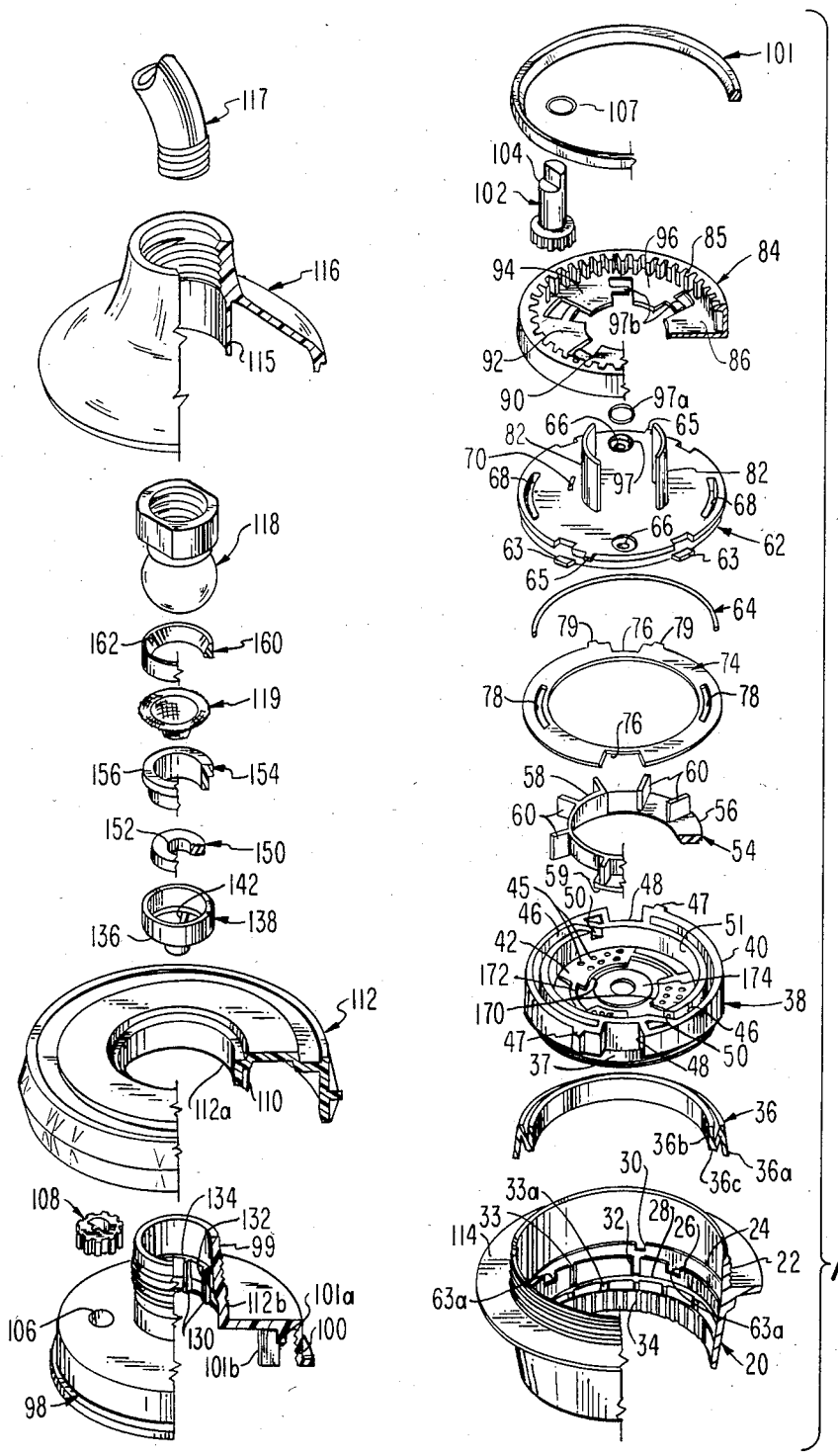
FIG. 3 is an exploded isometric view of components included within the apparatus as shown in FIGS. 1 and 2.
Figure 5A:
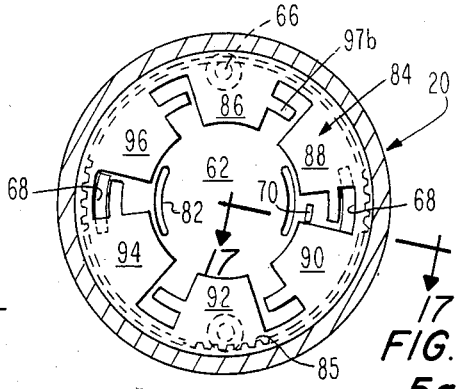
Figure 8:
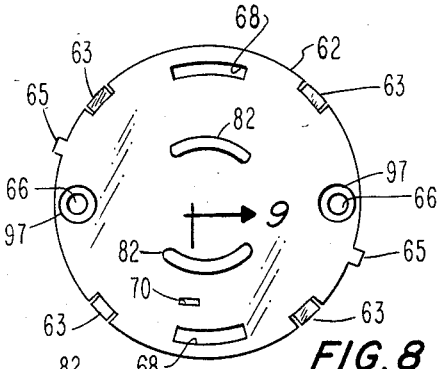
Figure 9:
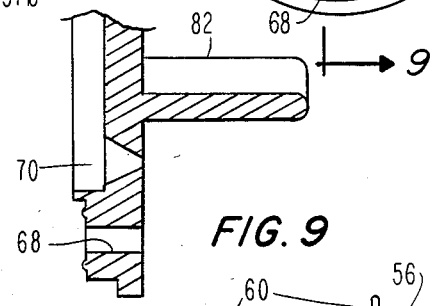
Figure 11:
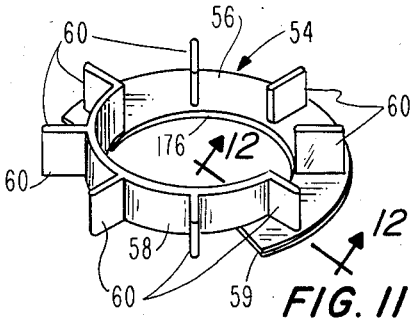
Figure 10:
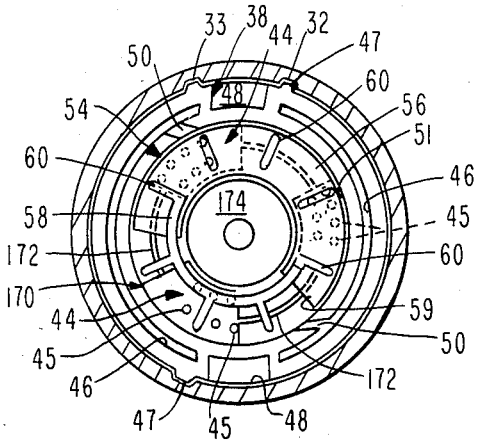
Figure 12:
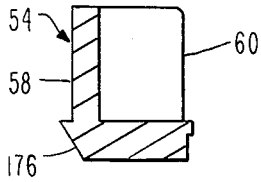
Figure 13:
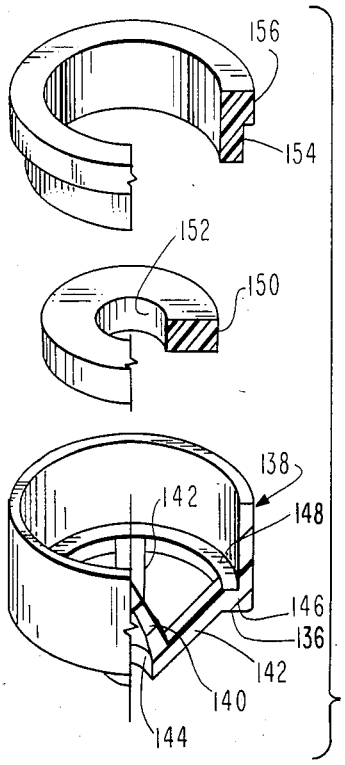
Figure 14:
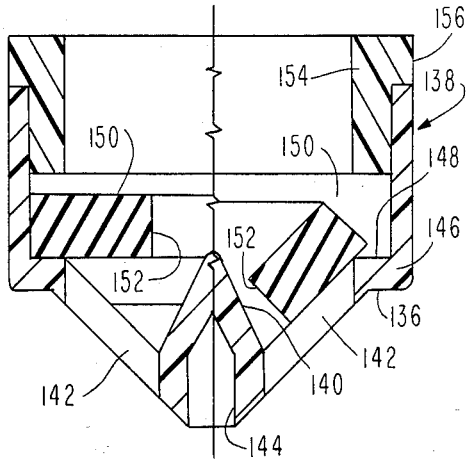
Figure 15:
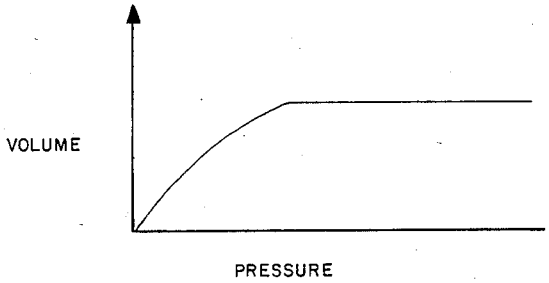
Figure 17:
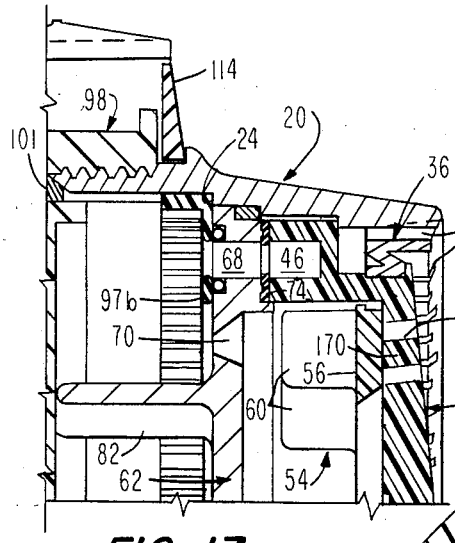
Figure 16:
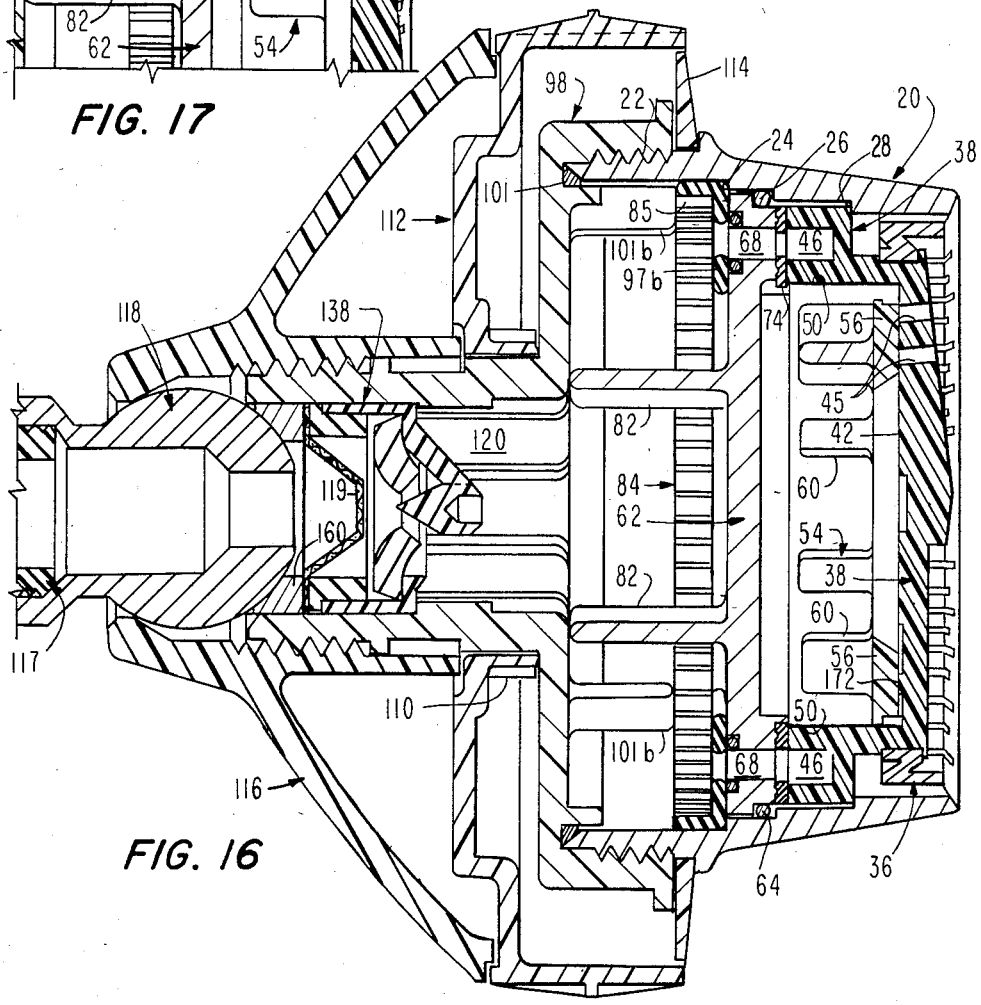

FIG. 8 is a plan view of a flow-directing plate shown in FIGS. 3 and 4;

FIG. 9 is a cross-sectional view taken along the line 9—9 in FIG. 8;

FIG. 10 is a cross-sectional view taken along the line 10—10 in FIG. 4;

FIG. 11 is a perspective view of a turbine included within the apparatus of FIGS. 1–4;

FIG. 12 is a fragmentary cross-sectional view taken along the line 12—12 in FIG. 11;

FIG. 13 is an exploded and enlarged perspective view of components shown in FIGS. 3 and 4;

FIG. 14 is an enlarged cross-sectional view of FIG. 13 as assembled but with the left half illustrating one condition and the right half illustrating a different condition;

FIG. 15 is a graph illustrating operation of the apparatus particularly delineated in FIGS. 13 and 14;

FIG. 16 is a full section taken along the line 16—16 in FIG. 2;

FIG. 17 is a partial section taken as along the line 17—17 in FIG. 5*a;*

Figure 18:
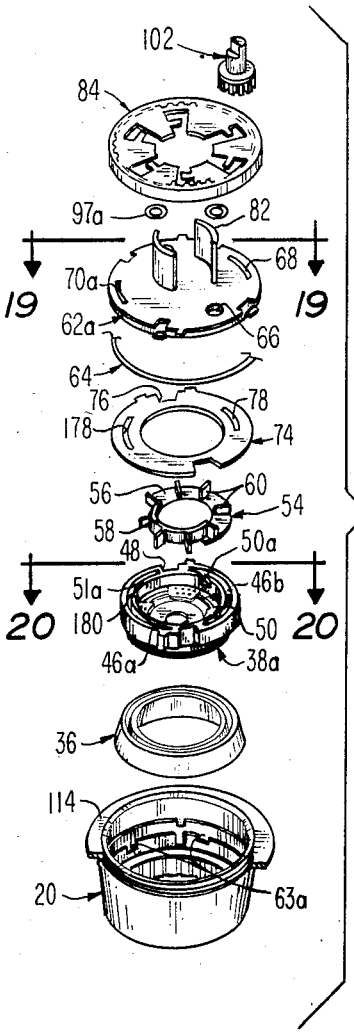
Figure 19:
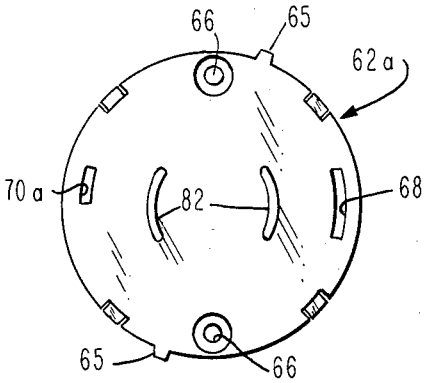
Figure 20:
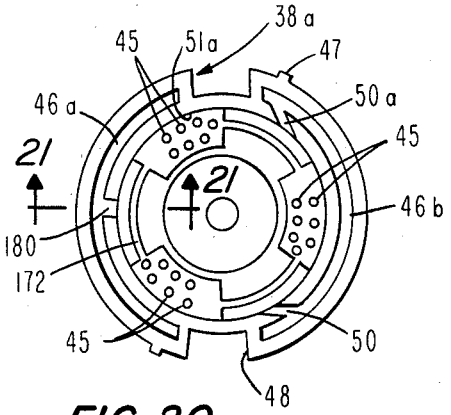
Figure 21:
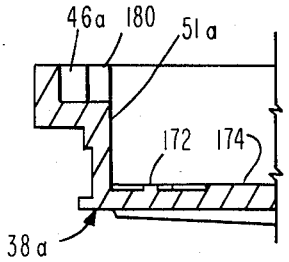
Figure 22A:
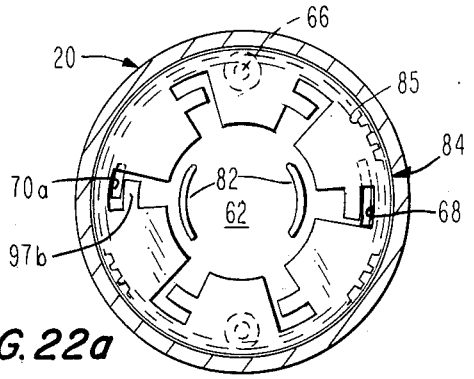
Figure 22B:
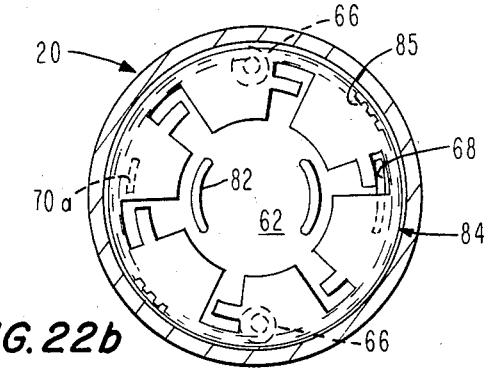
Figure 22C:
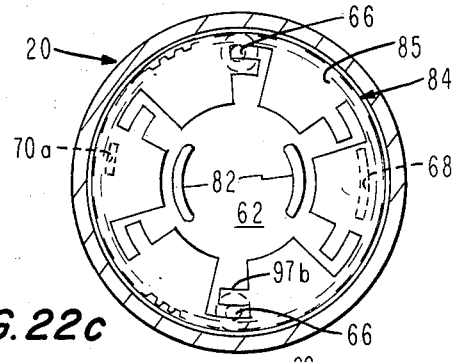
Figure 22D:
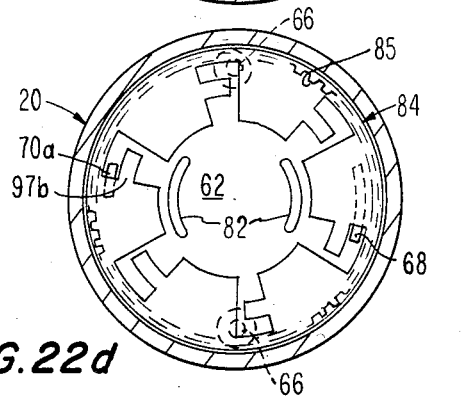

FIG. 18 is an exploded perspective view of a portion of an alternative embodiment;

FIG. 19 is a plan view of a flow directing plate shown in FIG. 18;

FIG. 20 is a plan view of a spray cup shown in FIG. 18;

FIG. 21 is a partial section view taken along the line 21—21 in FIG. 20; and

FIGS. 22*a*–22*d* are views analogous to FIGS. 5*a*–5*d* but illustrating operation of the alternative embodiment of FIG. 18.

Figure 1:
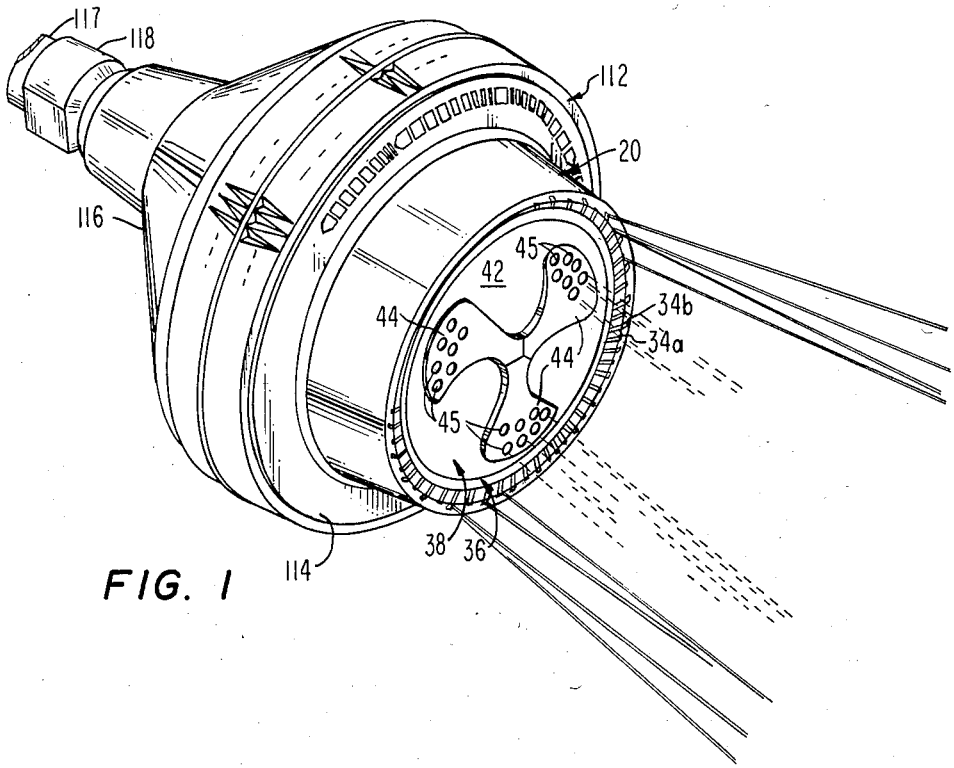
FIG. 1 is an isometric view of a completed showerhead incorporating the features of the present invention.

FIG. 1 depicts a showerhead constructed for connection to and mounting upon a stationary supply pipe as conventionally emerging through the wall near the top of a shower stall. By comparison with the aforesaid U.S. Pat. No. 3,801,019, it will be observed that essentially the same structure may be arranged for attachment to the end of a flexible pipe so as to be capable of being held in the hand of the user. Either form of usage and adaptation is contemplated for the embodiments specifically described herein.

In a principal embodiment, the showerhead includes a lower housing 20 of hollow cylindrical configuration formed to present an externally threaded neck 22 at its upper end. The internal central passage through lower housing 20 is formed to define three radial shoulders 24, 26 and 28 which provide seats for axially locating other elements of the showerhead to be described. A pair of sets of diametrically-opposed longitudinal slots 30 and 32 extend downwardly respectively from shoulders 24 and 26 to orient rotatively such other elements. Another slot 33, extending downwardly from shoulder 26 serves further to orient one of those elements. A circumferentially-spaced series of nubs 33*a*, projecting radially inward just beneath shoulder 28, serve to facilitate proper seating with respect to slots 34 and a seal 36. Slots 34 extend longitudinally from a position below shoulder 28 and define fluid spray outlet channels at the lower end of lower housing 20. Moreover, slots 34 are disposed in circumferentially and successfully spaced pairs of slots 34*a* and 34*b* individually of respective different inclinations relative to the overall longitudinal axis of the showerhead unit. Seal 36 is seated to extend across the open radially-inward sides of slots 34 in order to complete definition of those slots as one group of spray discharge outlets. At its radially-inward side, seal 36 is seated within an annular groove 37 formed on the exterior of a spray cup 38 that has a tubular main body 40 and an end wall or orifice plate 42 closing the bore of body 40.

Seal 36 is formed of a resilient material such as rubber. It has an integral N-shaped cross section, in the longitudinal direction of the unit, composed of a pair of longitudinal legs 36*a* and 36*b* spaced apart by a connecting web 36*c*. Leg 36*b* is of a length at least approximately the same as the width, in the longitudinal direction of the unit, of groove 37. When the unit is assembled, seal 36 is seated between slots 34 and groove 37 with leg 36*b* disposed in groove 37 and leg 36*a* extending across the open radially inner sides of slots 34 so as, together with those slots, to define a group of orifices or outlets distributed around the lower end of housing 20. As shown, the outer sides of those orifices are inclined with respect to the longitudinal axis of the unit so that within each pair a slot 34*a* defines an angle of two degrees and a slot 34*b* defines an angle of five degrees. The result is the emergence of two different spray patterns in the form of cones having respective different divergence angles. In a preferred unit, there are thirty pairs of slots 34. Additional particularization as to the desired detailed construction of seal 36 is set forth in aforementioned U.S. Pat. No. 3,958,756, and that application is incorporated herein by reference. Alternatives for seal 36 are described in that prior patent.

Formed through end wall 42 are three like groups 44 of seven discharge orifices 45 in each group and which lie in a symmetrical relationship within an annular band concentric with the central axis of the unit. Formed into the upperwardly-facing end portion of body 40 are a pair of similar flow-carrying troughs 46 each of which extends partially around the circumference of member 40 with the two being in symmetrically-disposed relationship. The adjacent ends of troughs 46 terminate short of each other so as to allow for the definition of a diametrically-opposed pair of longitudinally extending flow passages 48. Formed into the inner wall of each of troughs 46 is a tangentially-directed passage 50 that permits water under pressure within the respective trough to be discharged into the interior cavity 51 centrally defined within body 40. Body 40 is so formed as to define, below troughs 46, a peripheral margin that seats upon lowermost shoulder 28 and which, together with laterally projecting lugs 47 receivable within slots 32, serves to locate body 40, and thus spray cup 38, within lower housing 20. When spray cup 38 is seated within lower housing 20, seal 36 is radially compressed so that, as already described, its leg 36*a* is disposed over slots 34 to define one group of orifices, while orifices 45 in end wall 42 define a second group of spray discharge orifices.

A rotary valve member 54 rests upon the inner or upper side of end wall 42 and is retained by the inner wall of body 40 for rotation about the central axis of the unit. Valve member 54 is a one-piece molded element preferable of a glass-reinforced nylon material. Member 54 includes a flat, generally C-shaped base plate portion 56 which lies in a radially central plane and extends for approximately 225° about its central axis. A semi-cylindrical portion 58 is integrally joined to the opposite ends of portion 56 and extends circumferentially around the remaining 135° of member 54. The lower margin of semi-cylindrical portion 58 is coplanar with the top or upper flat surface of portion 56, so that the latter has its lower surface 59 spaced downwardly from the lower margin of portion 58. A plurality of radially extending blades 60 are integrally mounted upon and circumferentially spaced about portions 56 and 58 in symmetrically-spaced relationship to the central axis of the unit.

Underlying surface 59 of portion 56 rests upon the inner surface of end wall 42 and is so located as to overlie, at all times and rotative positions, at least a portion of orifices 45. The annular band within which orifices 45 lie corresponds in general to the annular band traversed by portion 56 upon rotation of valve rotor 54. Blades 60 are so located as to be impinged upon by water discharged through tangential passages 50. Valve rotor 54 thus is driven in rotation at a rate which varies with the rate of flow of water through tangential passages 50 of the spray cup assembly.

A flow-directing plate 62 overlies the upper end of spray cup 38 and is employed to direct and control the flow of water to the various discharge orifices and outlets. An O-ring 64, retained by tabs 63, seals the lower perimeter of plate 62 atop shoulder 26, diametrically opposed nubs 65 laterally projecting from plate 62 and seating within slots 30 while notches 63*a* in shoulder 26 seat tabs 63. Diametrically disposed near the lateral margins of plate 62 are a pair of circular openings 66 and a second pair of segmentally-shaped openings 68. Also included is another segmental opening 70. Nubs 65 orient plate 62 relative to spray cup 38, so that openings 66 are longitudinally aligned with and communicate directly with flow passages 48 in spray cup 38.

In the same way, openings 68 in plate 62 are aligned and communicate with troughs 46 of spray cup 38, while opening 70 is located radially inwardly of the inner wall of spray cup 38. A gasket 74 is disposed between the lower side of plate 62 and the upper end of spray cup 38. Gasket 74 has notches 76 and openings 78 respectively aligned with openings 66 and 68 in plate 62. Spaced to either side of one of notches 76 are outwardly projecting lugs 79 that seat gasket 74 respectively in slots 32 and 33 of lower housing 20.

The underside of plate 62 is formed to define respective portions of passages 66, 68 and 70 so as to cooperate with the coordinating passage portions defined in spray cup 38 as well as with notches 76 and openings 78 in gasket 74. That is, the generally tubular body portion of the housing which contains valve member 54 and tangential passages 50 is characterized by mating walls through which the different flow paths or passages wholly or partially extend. On the wall defined by the bottom side of plate 62 is a projecting rib that is pressed into seating engagement with gasket 74 so as to extend continuously around the general perimeter of the underside of plate 62 and is so disposed relative to openings 68 and 66 as to serve as a seal director. Further details in this respect may be had by reference to the aforesaid U.S. Pat. No. 3,958,756 which is incorporated by reference herein.

Integrally projecting from the upper surface of plate 62 are a pair of upwardly projecting compression tabs 82. Slidably supported for rotation upon the upper surface of plate 62 is an annular shutter plate 84 which has an internal ring gear 85 and six inwardly-projecting symmetrically-disposed segmentally-shaped shutter blades 86, 88, 90, 92, 94 and 96, those blades projecting inwardly from the lower margin of ring gear 85.

As perhaps best seen in FIGS. 5*a*–5*d*, the radially-inward extent of shutter blades 86–96 is the same for all of those blades and is sufficient that any blade is capable upon proper positioning to cover, and thereby close, opening 70, while open spaces between successive blades are aligned so as to be positionable over either openings 66 or openings 68. In principle, it is not necessary that the individual ones of the different webs or shutter blades 86–96 be divided into separate physical segments. Instead, a continuous web could be employed with a succession of spaced openings therethrough in alignment with water-flow openings 66 and 68 and with an additional series of openings staggered with an orientation to accommodate the necessary opening and closing of opening 70. However, the use of a plurality of individual blades may overcome stress and tolerance problems that otherwise could cause failure of complete sealing of different passages when dictated.

Directing attention again to each of passages 66 in plate 62, a counterbore 97 extends a short distance into each of passages 66 from the inlet side of plate 62. Seated within each of counterbores 97 is an O-ring 97*a* which serves as a resilient annular seal element. Considering the peripheral portions of plate 84 that join the different ones of the shutter blades as being divided portions of the base of the blades themselves, it will be observed that at least one blade always serves at least partially to captivate a corresponding one of O-rings 97*a*. To extend the degree of such captivation of the corresponding O-rings 97*a*, web members 97*b*, spaced inwardly from the periphery of plate 84, project at least substantially across the respective spaces between successive ones of the shutter blades. Web members 97*b* are in a position that maintains captivation of O-rings 97*a* even when shutter plate 84 is so moved as to remove the corresponding ones of the blade from a covering relationship to openings 66. To that end, each of web members 97*b* projects integrally from one side of one of the shutter blades and extends into close-spaced relationship with the successive one of the blades.

The individual parts described thus far are held in their assembled position by an upper housing 98 that has a centrally-disposed upstanding tube 99 and a downwardly-depending skirt 100. Skirt 100 is internally threaded so as to receive the external threads on the upper end of lower housing 20 as at 22. The exterior outer periphery of that upper end of lower housing 20 is tapered so as to wedge into and beneath a resilient diametrical seal 101 seated within a circumferential rib 101*a*, so as to complete a seal between the upper and lower housings.

Rotation of shutter plate 84 is accomplished by a pinion gear 102 meshed with ring gear 85 and having its shaft 104 rotatively received within a bore 106 in upper housing 98. An O-ring 107 (FIG. 3) seals shaft 104 to bore 106. A second gear 108, rotatively locked to shaft 104 exteriorly of upper housing 98, is meshed with a gear 110 integrally formed on a control ring 112 rotatively supported by an integrally-formed journal 112*a* which rides upon a bearing 112*b* defined on tube 99.

Circumferentially-spaced and outwardly-depending struts 101*b* project slightly below the lower margin of skirt 100 so as, together with tabs 82, to insure a tight seal of all matable elements in order to avoid leakage through the joints between the different connecting parts. During assembly, an annular ring 114 is trapped between the lower end of upper housing 98 and a shoulder on lower housing 20. Ring 114 is primarily for cosmetic purposes. It provides a stationary member upon which a scale, for indicating the rotative position of control ring 112 relative to the housing, may be located.

An upper cone 116 is threaded upon the upper end of tube 99. Cone 116 frictionally clamps a swivel ball fitting 118, which carries a screen 119, so as to mount the assembly upon a supply pipe 117. Cone 116 has a forward sleeve margin 115 which also serves as a stop against rearward movement of control ring 112.

The foregoing description could be understood only with reference to FIGS. 1–5, although FIGS. 6–12 might also be helpful. It should be noted that there has been a failure to make reference to certain components shown in these figures and that there are some differences in those figures thus far discussed as compared with the prior patents which are incorporated herein by reference. The following description of the operation will be seen to be similar to that disclosed in prior U.S. Pat. Nos. 3,801,019 and 3,762,648, but there are significant differences.

The overall approach of the particular embodiment herein primarily illustrated is that of delivering three general types of sprays. The first is an all-continuous spray in which all water discharged from the showerhead is delivered as a continuous and uninterrupted stream or series of streams. The second is an all-pulsating spray in which all water delivered from the showerhead is discharged in pulsating or cyclically interrupted streams. The third is a combination of continuous-pulsating spray in which a portion of the water is discharged in continuous streams while the remaining portion is discharged as a pulsating or interrupted spray. The showerhead, when discharging a combination proportions relative amounts of continuous spray to pulsating spray. This adjustment is made in a manner such that the frequency of pulsation of the pulsating spray component is increased as the proportion of the pulsating spray to the continuous spray is changed. When the device is operated to produce an all-pulsating spray, the frequency of pulsation of the spray may be selectively varied. In a significant improvement, the device is operable to deliver a continuous spray along with a pulsating spray with the pulsating spray being adjusted so that its frequency of pulsation is at the lower end of its range of frequency adjustment.

In use, water from the stationary supply pipe 117 enters the showerhead through ball fitting 118. Addressing for the moment shutter plate 84, it will be seen that the inlet chamber is provided with two sets of outlets constituted of openings 66, 68 and also with outlet 70 through flow directing plate 62. Those openings respectively constitute the inlet ends of three separate and distinct flow passages through the showerhead. With reference to FIG. 16, a first flow passage, starting from ball fitting 118 and an inlet chanber 120, extends from opening 68 to the interior through 46 of spray cup 38 and thence through tangential passages 50 into the interior of spray cup 38 so as to communicate with discharge orifices 45. Water following this first flow passage impinges on blades 60 or rotary valve member 54 as the water is discharged from tangential passages 50. Thus, the water following this flow passage drives valve rotor 54 in rotation so as cyclically to interrupt the streams of water discharged from orifices 45 as portion 56 on valve 54 rotates through overlying relationship with the individual ones of orifices 45.

Referring now to FIG. 17, a second flow passage extends from inlet chamber 120 through opening 70 in plate 62 and passes from opening 70 directly into the interior of spray cup 38 for discharge through orifices 45. Because water flowing through this second flow passage 70 is discharged axially to the interior of spray cup 38, water following the second flow passage 70 does not contribute to the rotary speed of valve rotor 54 and, in fact, exerts a slight braking action on rotor 54 as rotating blades 60 are struck by the axially directed stream from opening 70. The water following the first and second passages is divided at plate 62 and recombines within the interior of spray cup 38 prior to discharge through orifices 45. Consequently, all water flowing through those first and second flow passages is discharged from orifices 45 as a pulsating spray.

With reference to FIG. 4, a third flow passage extends from inlet chamber 120 through opening 66 in plate 62. Openings 66 are aligned with passages 48 on the exterior of spray cup 38, passages 48 communicating directly with the second group of orifices or outlets 34. Because the third flow passage is at the exterior of spray cup 38, water flowing through the third flow passage bypasses valve rotor 54 and is discharged in a continuous stream from outlets 34.

Control of the frequency of pulsation of the spray and the apportioning of the relative amounts of pulsating to non-pulsating spray is accomPlished by rotatively positioning shutter plate 84 so as fully or partially to block openings 66, 68 and 70 in accordance with the position of the various shutter blades relative to the openings. Referring to FIGS. **5*a*–5*d*, shutter plate 84 is shown in four different basic positions of rotative adjustment relative to flow directing plate 62. As will be discussed, intermediate positioning enables further variation. Rotation of shutter plate 84 is accomplished by annular rotation of control ring 112, gear 110 on control ring 110 driving pinion 108 so as to rotate shaft 104 and pinion 102. Pinion 102 is in mesh with ring gear 85 of shutter plate 84. Upon the positioning of shutter plate 84 toward the position shown in FIG. 5*a*, the area of openings 68 exposed between shutter blades 88, 90, 94 and 96 remains constant. However, as shutter plate 84 has been rotated clockwise away from the FIG. 5*b* position, the trailing edge of shutter blade 90 has begun to expose opening 70 and an increasing portion of the water flowing through the device passes through opening 70**.

In or near the position of FIG. **5*a*, water passing through opening 70 follows the second flow passage described above and is discharged from opening 70 axially into the interior of spray cup 38. The radial location of opening 70 is such that water flowing from that opening passes axially through the rotary path of blades 60, thus exerting a slight braking or retardive action on the rate of rotation of the blades. The rate of rotation of the blades is further reduced due to the fact that, with the volume of flow through opening 70 beginning to build up as the position of FIG. 5*a* is approached, there is a constant reduction in the volume of flow that otherwise would occur through openings 68, troughs 46 and tangential passages 50. That is, there is a reduction in the volume and rate of flow of water discharged through passages 50 from which the driving force causing the rotation of valve rotor 54** is derived.

With rotation of shutter plate 84 to the position of FIG. **5*b*, shutter plate 84** is so positioned that openings 66 are completely covered by shutter blades 86 and 92, opening 70 is completely covered by shutter blade 90, while one-half of each of openings 68 is covered by blades 90 and 96. With shutter plate 84 in this rotative position, the only openings in flow directing plate 62 which are exposed are openings 68. Hence, all flow through the showerhead occurs through the first flow passage referred to above—namely, from openings 68 to troughs 46 and then via tangential passages 50 into the interior of spray cup 38 for discharge through orifices 45. As already indicated, water passing through passages 50 impinges on blades 60 or creates a forced vortex to drive valve 54 in rotation and thus cyclically open and close orifices 45. Because all of the water flowing through the unit, when shutter plate 84 is in the position of FIG. 5*b*, must be discharged through orifices 45, all of the spray discharge is in pulsating form. Further because of the fact that all of the water then flowing through the showerhead impinges on or otherwise moves blades 60, valve 54 is then driven at a maximum rate of rotation for a given amount of supply pressure, and the frequency of the pulsation of the derived streams is at a maximum.

Figure 5B:
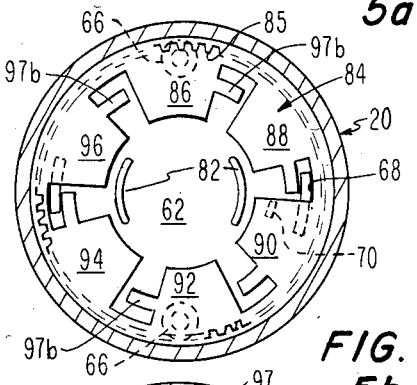

Because openings 66 remain blocked during movement of shutter plate 84 between the FIGS. 5*a* and 5*b* positions, all flow through the unit occurs within the first and second flow passages described above, these flows being united in the interior of spray cup 38 and thus being discharged through orifices 45. Therefore, an all-pulsating flow is achieved throughout the full range of movement of shutter plate 84 between the FIG. 5*a* and FIG. 5*b* positions. However, the frequency of pulsation of this flow varies in accordance with the rotative position of shutter plate 84, the frequency being a minimum when the maximum area of exposure of opening 70 is achieved in the FIG. 5*a* position and the frequency of pulsation increasing as shutter plate 84 is rotated from the FIG. 5*a* position toward the FIG. 5*b* position at which the pulsation frequency reaches a maximum for a given supply pressure.

Figure 5C:
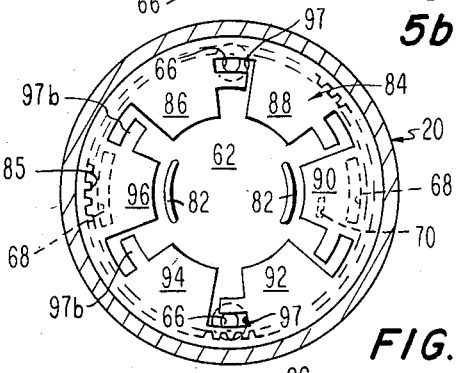

Upon movement of shutter plate 84 in a counterclockwise direction from the FIG. 5*b* position toward the FIG. 5*c* position, opening 70 remains covered by shutter blade 90, while the counterclockwise movement of shutter blades 86 and 92 begins progressively to expose openings 66 to flow from chamber 120. Furthermore, counterclockwise movement of shutter blades 90 and 96 from the FIG. 5*b* position toward the FIG. 5*c* position progressively reduces the area of openings 68 available to flow from inlet chamber 120 until, upon arrival of shutter plate 84 at the FIG. 5*c* position, openings 68 are completely covered by shutter blades 90 and 96, while shutter blades 86 and 92 have moved to positions whereby openings 66 are fully open.

When shutter plate 84 is in the FIG. 5*c* position, all flow through the unit occurs by way of the third flow passage previously mentioned. That flow passes from openings 66 through passageways 48 along the exterior of spray cup 38 so as to be discharged from the outer ring of orifices 34. Because the flow to orifices 34 completely bypasses rotary valve 54, all water discharged from orifices 34 is delivered in the conventional continuous stream. Thus, when shutter plate 84 is in the FIG. 5*c* position, an all-continuous spray is discharged by the device.

When shutter plate 84 is at some position intermediate the FIG. 5*b* and 5*c* positions, both openings 68 and openings 66 are partially opened so that flow through the device is apportioned between those two sets of openings in accordance with the rotative position of shutter plate 84. At these intermediate positions, the spray discharge consists of a continuous spray component constituted by that portion of the flow which passes through openings 66 and a pulsating spray portion constituted by the remaining portion of the flow which passes through openings 68. Over this range of movement of shutter plate 84, the frequency of pulsation of the pulsating portion of the spray will likewise vary in portion to that component of the flow which passes through orifices 45. Starting from an all-continuous flow with shutter plate 84 in the FIG. 5*c* position, rotation of shutter plate 84 toward the FIG. 5*b* position produces a gradually increasing component of pulsating flow that has a progressively increasing frequency as the FIG. 5*b* position is approached. In the mode of operation defined by this range, opening 70 remains closed, as previously mentioned.

Figure 5D:
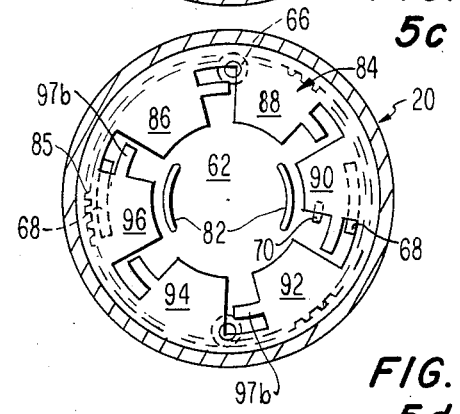

A further mode of operation is developed when shutter plate 84 is rotated further in a counterclockwise direction from its position as shown in FIG. 5*c* to that as shown in FIG. 5*d*. In this condition, all of openings 66, 68 and 70 are partially open. The partial flow through opening 70 causes the turbine to be slower by reducing the turbine drive force, and the partial flow through openings 66 causes another portion of the inletted water to be bypassed to outlets 34 to produce a continuous spray. The reduction in speed of rotation of turbine or rotary valve member 54 means that the pulse spray delivered is in a slow mode, while at the same time there is also a continuous spray being delivered to the user.

To summarize the flow characteristics of the unit, starting with shutter plate 84 at the FIG. 5*c* position and assuming a constant supply pressure within inlet chamber 120, all flow emitted from the unit is discharged from orifices 34 in continuous uninterrupted or non-pulsating streams. As the control ring is rotated to drive the shutter plate in a clockwise direction away from the FIG. 5*c* position, the percentage of flow discharged from orifice 34 is progressively reduced, while a correspondingly increased percentage of the flow is discharged from orifices 45. Spray discharged from orifices 45 is a pulsating spray and, as the percentage of flow through orifices 45 builds up, the frequency of pulsation increases until shutter plate 84 reaches the FIG. 5*b* position at which time the percentage of spray discharged from orifices 34 has been decreased to zero. Continued rotation of control ring 112 to drive shutter plate 84 in a clockwise direction beyond the FIG. 5*b* position causes the device to discharge an all-pulsating spray but decreases the frequency of the pulsation as shutter plate 84 moves toward the FIG. 5*a* position. The frequency of pulsation may also be varied by changing the supply pressure through adjustments of any control faucets which may be included in the supply system.

Going in the opposite direction from the FIG. 5*c* position, rotation therefrom in a counterclockwise direction of shutter plate 84 results in a partial opening of all of the first, second and third passages. The result is development of a combination of slow pulse delivery as well as a continuous spray.

Spaced circumferentially around and projecting inwardly from the lower portion of the interior of tube 99 are a plurality of inwardly-projecting longitudinally-oriented ribs 130 circumferentially joined around their upper extent by an integral annular band 132 which has a radial thickness of about half the radial projection of ribs 130. The upper end surface of band 132 together with the upper end surfaces of ribs 130 together define a shoulder 134. Seated on shoulder 134 is a lower shoulder 136 projecting radially inward from the bottom of a cylinder 138 the external wall of which is slidingly receivable within the internal wall of the upper portion of tube 99. Coaxially disposed at the lower end of cylinder 138 is an upright cone 140 suspended from the inner margin of shoulder 136 by a plurality of successively-spaced radially-oriented and downwardly-depending struts 142. Opening from the bottom within cone 140 is a chamber 144.

The upper surface of a web 146 which forms downwardly-facing shoulder 136 defines an upwardly-facing shoulder 148. An annular washer 150 is slidably received within the internal wall of cylinder 138 so that its bottom peripheral margin rests upon shoulder 148 with its central opening 152 coaxially encircling the apex end portion of cone 140. Washer 150 is of a flexible and resilient material, so that it normally rests in a horizontal position as shown in the left half of FIG. 14, while it is capable of being so deformed downwardly by pressure upon its upper surface that its opening 152 is caused to move downwardly around the body of cone 140 as shown in the right half of FIG. 14. As it is so moved downwardly, the water flow passageway is progressively restricted.

A collar 154 is slidably received within the upper end of cylinder 138, so as loosely to captivate washer 150 in the illustrated and described position. An outwardly projecting flange 156 on collar 154 seats the collar atop cylinder 138. Seated within the uppermost end portion of tube 99 on top of collar 154 is a resilient seal 160 which defines a bevelled seat 162 against which ball 118 is pressed to captivate screen 119 when the entire unit is assembled as shown in FIG. 4.

Washer 150 and cone 140 cooperate to define a regulator which limits the rate of water flow through the fluid channel defined by tube 99 substantially to a predetermined maximum upon increase of water pressure beyond a selected level. This is illustrated in FIG. 15 wherein the abscissa repre$ents incoming pressure and the ordinate defines volume of flow. As shown, the volume of water flow steadily increases as the pressure is increased up to a selected point at which further increase in pressure does not result in any significant further increase in rate of water flow or volume. Preferably, the components are selected and designed so that, at an input water pressure of thirty p.s.i. on the fast pulse setting, the showerhead utilizes approximately 1.9 gallons of water per minute. That compares with a usage of 5.8 gallons of water per minute by a typical older showerhead. By contrast with such an older showerhead, a saving of about 20 gallons of water per five-minute shower may be effected. Translated to typical usage by a family of four taking an average of three showers per day, the saving could be as much as 22,000 gallons per year. Of course, there will be additional savings in energy usage to heat hot water.

It will be observed that cone 140 and washer 150 cooperate in the manner of a somewhat basic needle valve, although in this case it is the orifice defined by opening 152, rather than the needle defined by cone 140, which moves. Orifice or opening 152 moves by the deflection of the material of washer 150 that defines that orifice. The deflection of washer 150 may be expressed in mathematical terms to enable calcuation of the amount of flow for a given pressure, and non-linear programming techniques may be used to permit the achievement of an optimum design for a variety of different constraints which may be imposed as desired. However, an empirical approach, involving only a small amount of "cut-and-try" with extrapolation, will be satisfactory for present purposes. In any case, the spacing from washer 150 and the apex angle of cone 140 relative to the diameter, thickness and flexibility of opening 152 are selected to achieve the desired flow limiting.

An ultimate goal in pulsating showerheads is the attainment of a desirable perception of the water pulses upon arrival at the skin of the user. For a given input pressure and rate of water flow, this can be attained only by the giving of proper attention to outlet orifice numbers and sizes with relation to pulse frequencies. In the illustrated embodiment, of course, the water flow is caused to pulsate as a result of rotation of rotary valve member 54. Member 54 is a turbine the blades 60 of which are driven by streams emitted from passages or nozzles 50. More accurately, however, the water inletted through passages 50 creates a forced vortex that causes valve member 54 to seek to rotate along with that vortex of water.

At the same time, a static pressure is maintained within the cavity 51 at a level dependent upon the relationship between the net or average outlet area and the net inlet area for water flow. In general, both the perception of pulses by the user and even the operability of the unit are very much a function of water flow.

In view of the foregoing, the introduction of the regulator, composed essentially of washer 150 and cone 140, places stringent requirements upon the showerhead mechanism if proper operation is to be maintained. In particular, the limitation upon water flow rate imposed by the regulator means that a narrow variation in volume is present. At the same time, static back pressure by outlet orifices 45 becomes even more critical than, for example, in the aforesaid U.S. Pat. No. 4,190,207.

In accommodation of these restrictions, the number of outlet orifices 45 in each group 44 is reduced to a total of 7 individual orifices in each group with the prior leading orifices in the clockwise direction having been eliminated. The result of this change is to provide a longer "off" cycle and a shorter "on" cycle of the pulsating delivery as compared with the immediate prior patent. In turn, that change results in a more perceptible effect of the pulsating delivery when in the slow-frequency mode while the unit also is delivering the continuous spray as in accordance with the position of FIG. 5*d*.

It may be noted that, as compared with the embodiment detailed in U.S. Pat. No. 3,958,756, the present embodiment employs a total of only two of nozzles 50, one assigned with regard to each of the respective troughs 46. The vortex-driving in-flow area and the reduced out-flow area defined by orifices 45, together with the change in pulse timing resulting from an increase in the angle of shoe 56 and with a decrease in the extent of each the groups of orifices, all combine to increase the pulse output force and thereby increase the pulse perception by the user.

The increase in vortex cavity static pressure achieved by incorporation of the aforedescribed improvements is not, however, entirely advantageous. That is, the increased static pressure within cavity 51 tends to increase the drag between undersurface 59 of shoe 56 and end wall 42. As a result, rotary valve member 54 may tend to stall during lower flow rates occasioned by the limitations imposed by the regulation of cone 140 and washer 150.

To the end of avoiding such stalling, each group of outlet orifices 45 is located in an annularly segmental pad 170 slightly upstanding from the basic interior wall surface of end wall 42. Moreover, a circumferential rib 172, spaced inwardly from the periphery of end wall 42, upstands the same amount as and connects each adjacent pair of pads 170. Thus, undersurface 59 of shoe 56 rides evenly over the interiorly-facing surface of pads 170 and ribs 172, while the total surface contact between undersurface 59 and the contacting surfaces carried by end wall 42 is minimized.

Centrally located on the upper surface of end wall 42 is a cylindrical boss 174 which upstands an amount the same as that of pads 170 and ribs 172 and the perimeter of which is spaced slightly inwardly from the innermost margins of pads 170. Correspondingly, the inner marginal wall of shoe 56 is downwardly and inwardly tapered as indicated at 176 in FIG. 12. Boss 174 tends to hold rotary valve member 54 in centered relation within cavity 51.

All of these present and former improvements result in increased pulse force output for a given quantity of water flow or an equal or similar force output as compared with earlier versions but with a reduction in water flow. Rotary valve member 54 establishes a predetermined cycle of pulsation with desired flow and non-flow intervals, the flow capacity of the outlet is of a correspondingly predetermined amount, the cavity is dimensioned to exhibit a static pressure under normal fluid flow which enables rotation of the turbine, and the selection of the flow versus non-flow intervals is such as to enhance the static flow pressure within the cavity. The flow capacities of the inlet and outlet passages or orifices are selected in order to create substantially a maximum in the velocity of pulses of fluid from the outlet orifices.

FIG. 18 illustrates an alternative in the achievement of output pulse frequency control. Only those portions of the showerhead necessary to an understanding of this alternative are shown in FIG. 18, it being understood that the other components necessary for a complete and operative assembly, as shown in FIGS. 1–4, also are included and the general manner of selection as between spray and pulsating modes is the same as previously discussed with regard to FIGS. *5a–5d*. The device of this alternative includes a lower housing 20, seal 36, spray cup 38*a*, rotary valve member 54, gasket 74, flow director plate 62*a* and shutter plate 84. Components changed in the alternative of FIG. 18, as compared with the similar components of the preceding figures, have been denoted by adding a lower-case letter to the corresponding number. Thus, only spray cup 38*a* and flow director 62*a* need have changes.

In more particular, flow director 62*a* is changed by eliminating opening 70 somewhat centrally located in the earlier version and restricting the segmental extent of one of openings 68 of the earlier version so as to become a speed control port 70*a*. Control port 70*a* is aligned with opening 178 in gasket 74 so as to allow water to enter trough 46*a* in spray cup 38*a*. There is no tangential passage 50 leading into chamber 51*a* from trough 46*a*. Instead, a single radially extending passage 180 leads from trough 46*a* into cavity 51*a*. The other trough 46*b* has a first tangential passage 50 as before and includes an additional and second tangential passage 50*a* near the other end of its segmental extent.

The result of the foregoing is that all water diverted to create the force vortex within cavity 51*a*, and thus cause the driving of valve member 54, is controlled by shutter plate 84 to enter slot 68 in flow divertor 62*a* and be discharged into cavity 51*a* through passages 50 and 50*a*. On the other hand, water diverted by shutter plate 84 into opening 70*a* is introduced into the outer edge of the forced vortex created within chamber 51*a*, and it is the water which enters through passage 180 that controls the speed or rotation of the turbine and the resulting rate of pulsation of the emitted streams.

The addition of water through passage 180 reduces the vortex effect otherwise created by drive passages 50 and 50*a*. At the same time, the water static pressure within chamber 51*a* is reduced. With only the addition of extra flow by way of passage 180, the pulse force output is increased, while the speed of pulsation is reduced. As shown by the different positions illustrated in FIGS. *22a–22d*, the amount of water diverted through driving slot 68 may be throttled down at the same time as the speed reduction port 70*a* is further opened.

Somewhat analogous to the discussion of FIGS. *5a–5d*, the condition shown in FIG. *22a* is one in which port 70*a* is almost fully exposed so that a near maximum of pulse speed reduction is activated as water is emitted, via openings 68 and 70*a* from the pulse discharge outlets 45. FIG. *22b*, however, illustrates the condition in which all discharge still is from pulse outlets 45 but in which port 70*a* is closed so that there is no speed reduction. Like FIG. *5c*, FIG. *22c* represents the relationship for an only all-continuous outlet from orifices 34*a* and 34*b* by way of flow through openings 66.

This permits maintaining a constant flow and further aiding in the achievement of speed reduction while yet not changing the pulse force output. One advantage for the mode of speed control illustrated in this alternative is that of achieving a more linear adjustment of pulsation rate. In addition, the introduction of the additional speed control by water flow into the peripheral margin of the forced vortex reduces the tendency of valve member 54 to stall at low water flows. Moreover, wider variation of speed may be obtained in the lower range of possible speed of pulsation.

Most significantly, FIG. *22d* corresponds to FIG. *5d*. When shutter plate 84 has been moved to the position of FIG. *22d*, all of openings 66, 68 and 70*a* are partially opened. Once again, therefore, the showerhead of this embodiment is capable of delivering the combination of slow-rate pulses from orifices 45 while there is at the same time obtained the delivery of a continuous spray from orifices 34*a* and 34*b* by way of flow through openings 66.

As will now be appreciated, the showerhead of the present invention provides a new mode of operation never before presented. While many of the beneficial features of the prior showerheads discussed have been retained, the additional combination of a continuous spray with an associated slowly pulsating spray yields a comfortable and desirable result as sensed on the skin of the user. At the same time, a major constraint has been lifted from the earlier showerheads cross-referenced. Now, rotation of control ring 112 encounters no stops or limits to its degree of rotation. Indeed, the user may start with one position and sequence the changes from one mode to another repeatedly, or he may stop at any one rotative position effectively of shutter plate 84 and, in effect, "back up". There no longer is any need for synchronization between some kind of indicator associated with the control ring and a description of various different modes. That is, the user can simply switch back and forth in either direction or continuously in one direction until achieving the kind of spray combination desired at the time.

In the embodiments illustrated, there is incorporated through pinion 108 and ring gear 85 a 2:1 ratio as between rotation of control ring 112 and shutter plate 84. This means that one complete revolution of control ring 112 will result in the attainment of two complete cycles of the sequential selection of the various different modes available as embodied. That means that only a total of four of the succession of webs 86–96 are utilized in any one complete revolution of control ring 112. While this arrangement has been found to yield a nicely efficient combination in satisfaction of all of the requirements of the various different flow rates in their respective different passages, it is fully contemplated to change either that ratio of comparative movements and/or the number of respectively different shutters on shutter plate 84. That is, a great deal of flexibility remains in particularizing the design choice as between the number of different apertures, shutters, openings and so forth.

Various alternatives may be made in the manner of assembly, and several have been tried with success. For example, notch 76 may be a hole in gasket 76 captivated on lips depending down from the wall of openings 66.

Additional trough portions may be formed on the underside of plate 62 in alignment with troughs 46 and communicating therwith through aligned openings in gasket 74 to eliminate possible pressure differentials.

While different embodiments of the invention have been shown and described, it will be obvious to those skilled in the art that changes and modifications may be made without departing from the invention in its broader aspects and, therefore, the aim in the appended claims is to cover all such changes and modifications as fall within the true spirit and scope of that which is patentable.

We claim:

1. In a showerhead that has an inlet, a series of circumferentially-spaced orifices, a series of spray outlets, a turbine with a valve for sequentially opening successive ones of said orifices, at least one nozzle for driving said turbine, a multiply-apertured flow director for communicating water to said nozzle, said orifices and said outlets, a control for selectively coupling water from said inlet to different ones of the apertures in said director and means for moving said control relative to said director, the combination comprising:

means in said showerhead defining a first passage from at least a first aperture in said director to said nozzle and through said valve to said orifices;

means in said showerhead defining a second passage from at least a second aperture in said director in bypass of said nozzle but through said valve to said orifices and in retardive interaction with said turbine;

means in said showerhead defining a third passage from at least a third aperture in said director to said outlets;

first shutter means defined on said control for closing said third passage, opening said first passage and variably opening said second passage during opening of said first passage as said control is moved;

second shutter means defined on said control for closing said first and second passages, while opening said third passage as said control is moved;

and said first and second shutter means being mutually oriented to at least partially open said second passage when said control is moved to a position in which both of said first and third passages are at least partially opened.

2. A showerhead as defined in claim 1 in which said first and second shutter means are mutually oriented to increase the degree of closure of one of said first and third passages as the degree of closure of the other of said first and third passages is decreased.

3. A showerhead as defined in claim 1 in which said second passage is only even partially opened only when at least one of said first and third passages is at least partially opened.

4. In a showerhead that has an inlet, a series of circumferentially-spaced orifices, a series of spray outlets, a turbine with a valve for sequentially opening successive ones of said orifices, at least one nozzle for driving said turbine, a multiply-apertured flow director plate for communicating water to said nozzle, said orifices and said outlets, a control plate for selectively coupling water from said inlet to different ones of the apertures in said director plate and means for moving said control plate relative to said director plate, the combination comprising:

means in said showerhead defining a first passage from at least a first aperture in said director plate to said nozzle and through said valve to said orifices;

means in said showerhead defining a second passage from at least a second aperture in said director plate in bypass of said nozzle but through said valve to said orifices and in retardive interaction with the speed of rotation of said turbine;

means in said showerhead defining a third passage from at least a third aperture in said director plate to said outlets;

a first shutter defined on said control plate for closing said third passage, opening said first passage and variably opening said second passage during opening of said first passage as said control plate is moved;

a second shutter defined on said control plate for closing said first and second passages, while opening said third passage as said control plate is moved;

and said control plate being movable to rotate said shutters relative to said director plate in continued revolution to effect repeated sequences of said openings and closings of said passages.

5. A showerhead as defined in claim 4 in which said first and second shutters are mutually oriented to at least partially open said second passage when said control plate is moved to a position in which both of said first and third passages are at least partially opened.

6. A showerhead as defined in claim 5 in which said first and second shutters are mutually oriented to increase the degree of closure of one of said first and third passages as the degree of closure of the other of said first and third passages is decreased.

7. A showerhead as defined in claim 4 in which a succession of sequences of said first and second shutters are spaced circumferentially, in which said second passage terminates in an aperture in said director plate located in the path of all of said shutters, in which said turbine rotates within a cavity defined within said showerhead and in which said second passage directs the flow of water directly into the interior of said cavity.

8. A showerhead as defined in claim 4 in which a succession of sequences of said first and second shutters are spaced circumferentially, in which said moving means includes a ring mounted on the exterior of said showerhead and means for gearing movement of said ring a predetermined amount to a movement of said control plate by an amount less than said predetermined amount.

* * * * *